US007854017B2

(12) United States Patent
Laton

(10) Patent No.: US 7,854,017 B2
(45) Date of Patent: Dec. 21, 2010

(54) PROTECTIVE GARMENTS THAT PROVIDE THERMAL PROTECTION

(75) Inventor: Michael Andrew Laton, Fayetteville, GA (US)

(73) Assignee: Southern Mills, Inc., Union City, GA (US)

( * ) Notice: Subject to any disclaimer, the term of this patent is extended or adjusted under 35 U.S.C. 154(b) by 0 days.

(21) Appl. No.: 11/411,621

(22) Filed: Apr. 26, 2006

(65) Prior Publication Data

US 2007/0137012 A1 Jun. 21, 2007

Related U.S. Application Data

(60) Provisional application No. 60/751,134, filed on Dec. 16, 2005.

(51) Int. Cl.
*A41D 13/00* (2006.01)
*A62B 17/00* (2006.01)
*A41D 27/02* (2006.01)

(52) U.S. Cl. ..... 2/81; 2/93; 2/82; 2/97; 2/272

(58) Field of Classification Search ..... 2/93, 2/81, 82, 85, 97, 272
See application file for complete search history.

(56) References Cited

U.S. PATENT DOCUMENTS

| | | | | |
|---|---|---|---|---|
| 3,802,841 | A | 4/1974 | Robin | |
| 3,888,821 | A | 6/1975 | Milford, Jr. | |
| 4,502,153 | A * | 3/1985 | Lapedes et al. | 2/81 |
| 4,710,200 | A | 12/1987 | Cates et al. | |
| 4,741,740 | A | 5/1988 | Davis et al. | |
| 4,748,691 | A * | 6/1988 | Grilliot et al. | 2/81 |
| 4,749,378 | A | 6/1988 | Cates et al. | |
| 4,755,335 | A | 7/1988 | Ghorashi | |
| 4,759,770 | A | 7/1988 | Cates et al. | |
| 4,766,743 | A | 8/1988 | Biancalani et al. | |
| 4,814,222 | A | 3/1989 | Davis et al. | |
| 4,843,646 | A * | 7/1989 | Grilliot et al. | 2/69 |
| 4,897,886 | A * | 2/1990 | Grilliot et al. | 2/81 |
| 4,898,596 | A | 2/1990 | Riggins et al. | |
| 4,900,323 | A * | 2/1990 | Dickson et al. | 8/111 |
| 4,985,046 | A | 1/1991 | Hartzler | |
| 5,001,781 | A * | 3/1991 | Grilliot et al. | 2/69 |
| 5,098,770 | A * | 3/1992 | Paire | 428/198 |
| 5,150,476 | A * | 9/1992 | Statham et al. | 2/93 |
| 5,174,790 | A | 12/1992 | Riggins et al. | |
| 5,200,262 | A | 4/1993 | Li | |
| 5,207,803 | A | 5/1993 | Holsten et al. | |
| 5,211,720 | A | 5/1993 | Johnson | |

(Continued)

FOREIGN PATENT DOCUMENTS

EP 0312509 A 4/1989

(Continued)

OTHER PUBLICATIONS

Excerpt from Dictionary of Fiber & Textile Technology, KoSa, Charlotte, NC, 1999, pp. 88-89.

*Primary Examiner*—Bobby H Muromoto, Jr.
(74) *Attorney, Agent, or Firm*—Kilpatrick Stockton LLP

(57) ABSTRACT

A thermally protective fabric includes a composition of inherently flame resistant fibers, and interstices having insulating pockets of air, wherein at least some of the air is incorporated into the interstices through a mechanical working process.

39 Claims, 2 Drawing Sheets

U.S. PATENT DOCUMENTS

| | | | | |
|---|---|---|---|---|
| 5,213,885 | A * | 5/1993 | Zogg et al. | 428/172 |
| 5,215,545 | A | 6/1993 | Cates et al. | |
| 5,221,287 | A | 6/1993 | Reinert | |
| 5,236,769 | A * | 8/1993 | Paire | 428/196 |
| 5,306,312 | A | 4/1994 | Riggins et al. | |
| 5,514,457 | A | 5/1996 | Fels et al. | |
| 5,515,543 | A * | 5/1996 | Gioello | 2/69 |
| 5,685,932 | A * | 11/1997 | Stohr et al. | 264/44 |
| 5,860,163 | A * | 1/1999 | Aldridge | 2/81 |
| 5,896,583 | A * | 4/1999 | Grilliot et al. | 2/81 |
| 5,920,905 | A * | 7/1999 | Aldridge | 2/81 |
| 5,928,971 | A * | 7/1999 | Ellis et al. | 442/76 |
| 6,042,615 | A * | 3/2000 | Habereder et al. | 8/102 |
| 6,077,316 | A * | 6/2000 | Lund et al. | 8/115.6 |
| 6,110,558 | A | 8/2000 | Billingsley et al. | |
| 6,247,179 | B1 * | 6/2001 | Underwood et al. | 2/81 |
| 6,296,023 | B1 * | 10/2001 | Gehrhardt et al. | 139/420 A |
| 6,341,384 | B1 * | 1/2002 | Hayes | 2/458 |
| 6,430,754 | B1 * | 8/2002 | Taylor et al. | 2/458 |
| 6,451,070 | B1 | 9/2002 | Kent et al. | |
| 6,481,015 | B1 * | 11/2002 | Lanier | 2/2.5 |
| 6,607,562 | B2 * | 8/2003 | Ghorashi et al. | 8/115.51 |
| 6,840,967 | B1 | 1/2005 | Riggins et al. | |
| 7,013,496 | B2 * | 3/2006 | Dunn | 2/458 |
| 7,231,888 | B1 * | 6/2007 | Kelly et al. | 119/28.5 |
| 7,264,637 | B2 | 9/2007 | Cardamone et al. | |
| 7,279,520 | B2 | 10/2007 | Hausmann et al. | |
| 7,284,398 | B2 * | 10/2007 | Hubner | 66/192 |
| 2002/0069453 | A1 * | 6/2002 | Kelleher et al. | 2/458 |
| 2003/0228812 | A1 | 12/2003 | Stanhope et al. | |
| 2005/0050619 | A1 | 3/2005 | Dunn | |
| 2007/0192966 | A1 | 8/2007 | Cottrell et al. | |

FOREIGN PATENT DOCUMENTS

| | | | |
|---|---|---|---|
| EP | 0466423 | A | 1/1992 |
| EP | 0478301 | B1 | 6/1995 |
| GB | 1438067 | A | 6/1976 |
| JP | 06-192972 | A | 7/1994 |
| WO | 2006017709 | A | 2/2006 |
| WO | PCT/US2006/015801 | | 9/2006 |

* cited by examiner

PROTECTIVE GARMENTS THAT PROVIDE THERMAL PROTECTION

RELATED APPLICATION

This application claims priority to U.S. Provisional Application Ser. No. 60/751,134, entitled "MECHANICAL SOFTENING OF THERMAL BARRIER", filed Dec. 16, 2005, the contents of which are incorporated herein by reference.

TECHNICAL FIELD

The present disclosure relates to protective garments and protective fabrics generally, and to thermally protective garments and fabrics in particular.

BACKGROUND

Several occupations require the worker to be exposed to heat and flame. To avoid being injured while working in such conditions, the worker may wear protective garments constructed of special flame resistant materials. The protective garments may be various articles of clothing, including coveralls, trousers, or jackets.

For example, firefighters typically wear protective garments that are commonly referred to as turnout gear. Turnout gear may have several layers including, for example, a thermal liner that insulates from extreme heat, an intermediate moisture barrier that prevents the ingress of water into the garment, and an outer shell that protects from flame and abrasion.

In other cases, protective garments may comprise a single layer of material that is flame resistant. Single-layer protective garments may be worn by industrial workers such as petroleum and utility workers, foundry men, welders, and racecar drivers. Additionally, such protective garments may be worn by individuals performing military functions or urban search and rescue functions.

The thermal protection of protective garments may be improved by increasing the amount of insulation provided within the garment. However, increasing the insulation typically equates to increasing the weight of the garment. Unfortunately, such increases in weight may increase wearer fatigue and risk of heat stroke when the garment is worn in high temperature environments. Furthermore, bulkier protective garments may decrease the wearer's mobility.

From the above discussion, there is an apparent need for protective garments that are relatively thermally protective and are also relatively lightweight and flexible.

SUMMARY

A thermally protective fabric includes a composition of inherently flame resistant fibers, and interstices having insulating pockets of air, wherein at least some of the air is incorporated into the interstices through a mechanical working process.

In another embodiment, a thermally protective garment includes one or more layers, at least one layer having a composition of inherently flame resistant fibers and interstices having insulating pockets of air, wherein at least some of the air is incorporated into the interstices through a mechanical working process.

In another embodiment, a method of increasing the thermal protection provided by a thermally protective garment includes mechanically working fabric to incorporate air into interstices within the fabric, and constructing a thermally protective garment comprising the fabric, the thermally protective garment having increased thermal protection.

In another embodiment, a method of reducing the flexural rigidity of a thermally protective garment includes mechanically working fabric to incorporate air into interstices within the fabric, and constructing a thermally protective garment comprising the fabric, the thermally protective garment having increased thermal protection.

Other systems, devices, features, and advantages of the disclosed fabrics and garments will be or will become apparent to one with skill in the art upon examination of the following drawings and detailed description. All such additional systems, devices, features, and advantages are intended to be included within this description, are intended to be included within the scope of the present invention, and are intended to be protected by the accompanying claims.

BRIEF DESCRIPTION OF THE DRAWINGS

The disclosed protective garments and fabrics can be better understood with reference to the following drawings. The components in the drawings are not necessarily to scale.

DETAILED DESCRIPTION

As is described above, it would be desirable to produce a protective garment that is thermally protective yet relatively lightweight and flexible. As is described below, such a garment can be produced by mechanically working at least some of the fabric of the protective garment. Such mechanical working creates additional and/or enlarged interstitial spaces in the fabric that have insulating pockets of air. The insulating air pockets afford increased thermal protection without a corresponding increase in weight or fabric bulk.

Figure 1:
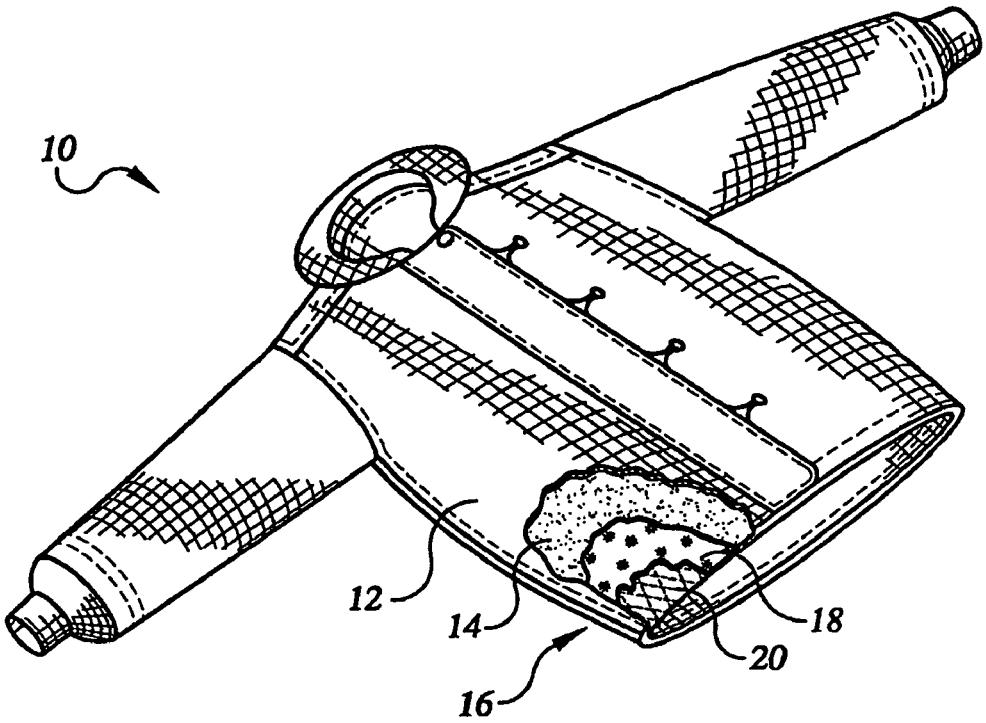
FIG. 1 illustrates a partial cut-away view of an embodiment of a protective garment.

FIG. 1 illustrates an example protective garment. More particularly, FIG. 1 illustrates firefighter turnout gear 10 in the shape of a coat. However, the present disclosure is not limited to firefighter turnout gear or to coats, but instead pertains to protective garments generally and to the fabrics that protective garments comprise. While a turnout gear coat has been illustrated for example purposes, the principles described herein can be applied to the fabric of other protective garments that are intended to provide thermal protection.

Figure 2:
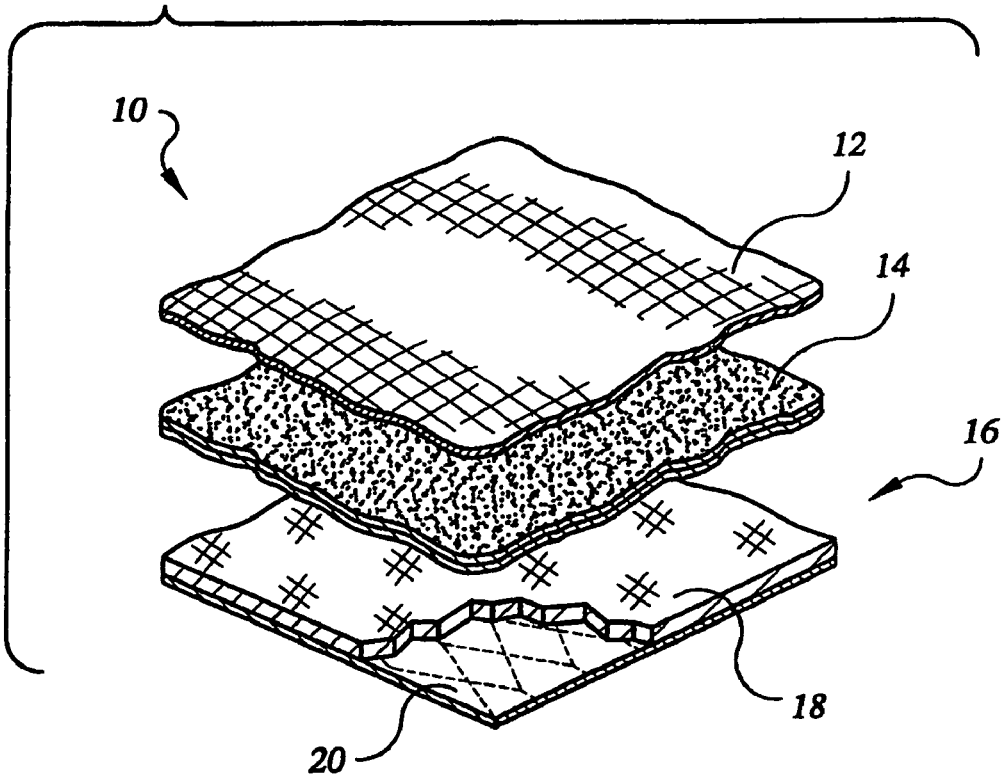
FIG. 2 illustrates an exploded perspective view of a portion of the garment illustrated in FIG. 1.

The protective garment may be composed of multiple layers. In embodiments in which the protective garment is turnout gear 10, the multiple layers may include an outer shell 12, a moisture barrier 14, and a thermal liner 16, as indicated in FIG. 2. The outer shell 12 is typically constructed of flame and abrasion resistant materials that comprise inherently flame resistant fibers made of, for example, aramid (meta-aramid or para-aramid), polybenzimidazole (PBI), polybenzoxazole (PBO), polypyridobisimidazole (PIPD), FR Rayon, or melamine. FR rayon is considered an inherently flame resistant fiber because a flame retardant is incorporated into the fiber while the fiber is being formed, and therefore the flame retardant cannot be removed from the fiber through a process such as washing.

The moisture barrier 14 is typically constructed from a non-woven or woven flame resistant fabric laminated to a water-impermeable layer of material. The flame resistant fabric can comprise inherently flame resistant fibers made of, for example, aramid or melamine. The water-impermeable layer of material can be, for instance, a polytetrafluoroethylene (PTFE), polyurethane, or a PTFE/polyurethane bicomponent membrane. The impermeable layer may be provided on the moisture barrier 14 so as to face the thermal liner 16.

The thermal liner 16 may comprise one or more layers of thermally protective material, which are typically quilted together. For example, the thermal liner 16 may include an insulation layer 18 and a facecloth layer 20. The insulation layer 18 may be a nonwoven material, such as a batt, comprising a plurality of inherently flame resistant fibers made from, for example, aramid, melamine, flame resistant (FR) rayon, modacrylic, or carbon fibers. In some embodiments, multiple insulation layers 18 may be used. The facecloth layer 20 may be constructed of woven material comprising inherently flame resistant fibers made of, for example, aramid, melamine, FR rayon, modacrylic, or carbon.

Figure 3:
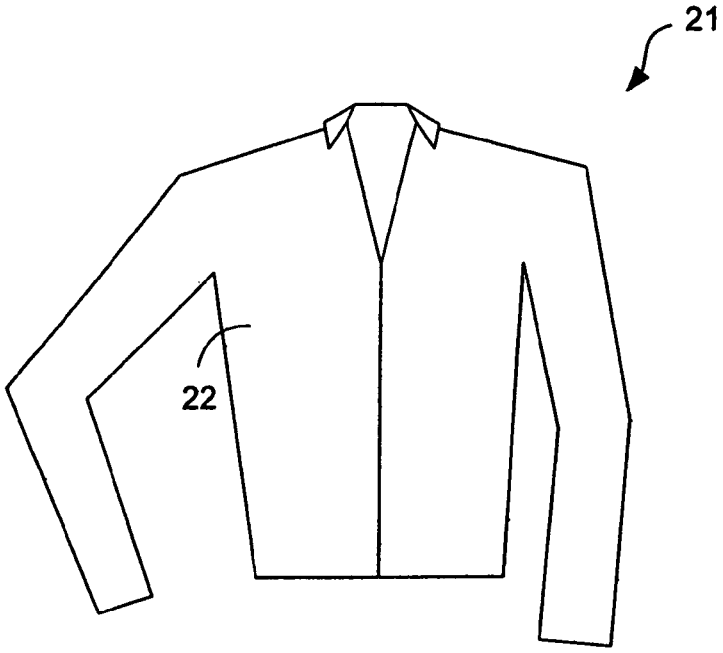
FIG. 3 illustrates a front view of an embodiment of a protective garment.

Although FIGS. 1 and 2 depict the protective garment as having multiple layers, the protective garment may comprise a single layer. For example, an industrial worker may wear a protective garment 21 that is a single layer 22, as shown in FIG. 3. The single layer 22 may be a fabric having a blend of fibers, wherein at least some of the fibers are inherently flame resistant. Example inherently flame resistant fibers that may be present in the blend include fibers made from aramid, polybenzoxazole (PBO), polybenzimidazole (PBI), polypyridobisimidazole (PIPD), FR rayon, FR modacrylic, carbon, or melamine. In some embodiments the fabric may include only inherently flame resistant fibers, and in other embodiments the fabric may be a blend of inherently flame resistant fibers and fibers that are not flame resistant, such as a blend of FR modacrylic and cotton.

In one embodiment the single layer 22 may be a fabric having fibers made from aramid, or a blend of aramid and FR Rayon. For example, the fabric may have about 100% meta-aramid. Alternatively, the fabric may have about 65% meta-aramid and about 35% FR rayon. In other cases, the fabric may have about 40% para-aramid and about 60% FR Rayon.

In other embodiments, the single layer may have fibers made from para-aramid and one of meta-aramid, PBI, PBO, PIPD, or melamine. For example, the fabric may have about 60% para-aramid fiber and about 40% of one of meta-aramid, PBI, PBO, PIPD, or melamine. In still other embodiments, the single layer may have fibers made from meta-aramid and FR modacrylic. For example, the fabric may have about 50% meta-aramid fiber and about 50% FR modacrylic.

Examples of para-aramid fibers include those that are currently available under the trademarks KEVLAR® (DuPont), and TECHNORA® and TWARON® (Teijin). Example meta-aramid fibers include those sold under the tradenames NOMEX T-450® (100% meta-aramid), NOMEX T-455® (a blend of 95% NOMEX® and 5% KEVLAR®), and NOMEX T-462® (a blend of 93% NOMEX®, 5% KEVLAR®, and 2% anti-static carbon/nylon), each of which is produced by DuPont. Example meta-aramid fibers also include fibers that are currently available under the trademark CONEX®, which is produced by Teijin. Example melamine fibers include Basofil® fibers produced by McKinnon-Land-Moran, LLC. Example PBO fibers include Zylon® fibers produced by Toyobo. Example PIPD fibers include M5® fibers produced by Magellan Systems International, Inc.

For purposes of the present disclosure, where a material name is used herein, the material referred to may primarily comprise the named material but may not be limited to the named material. For instance, the term "meta-aramid fibers" is intended to include NOMEX® T-462 fibers, which, as is noted above, comprise relatively small amounts of para-aramid fiber and anti-static fiber in addition to fibers composed of meta-aramid material.

As is described above, before the protective garment is formed one or more layers of the garment may be subjected to a mechanical working process. The mechanical working process may increase thermal protection by adding and/or enlarging interstitial spaces in the fabric layer so as to produce a more "open" construction for the fabric layer. For purposes of this disclosure, "mechanically working" processes are those processes that change the geometry or arrangement of fibers within the fabric through physical manipulation. Specifically, mechanical working causes the material to flex and open up by rubbing against itself or through contact (e.g., impact) with components of the mechanical working machine. It is believed that such mechanical manipulation causes inter-fiber slippage, which imparts the fabric with an open structure characterized by the addition and/or enlargement of interstices of the fabric having insulating pockets of air. The air that is incorporated into the additional and/or enlarged interstices through the mechanical working process increases the thickness of the fabric without increasing the weight or bulk of the fabric, providing additional insulation from heat.

Figure 4:
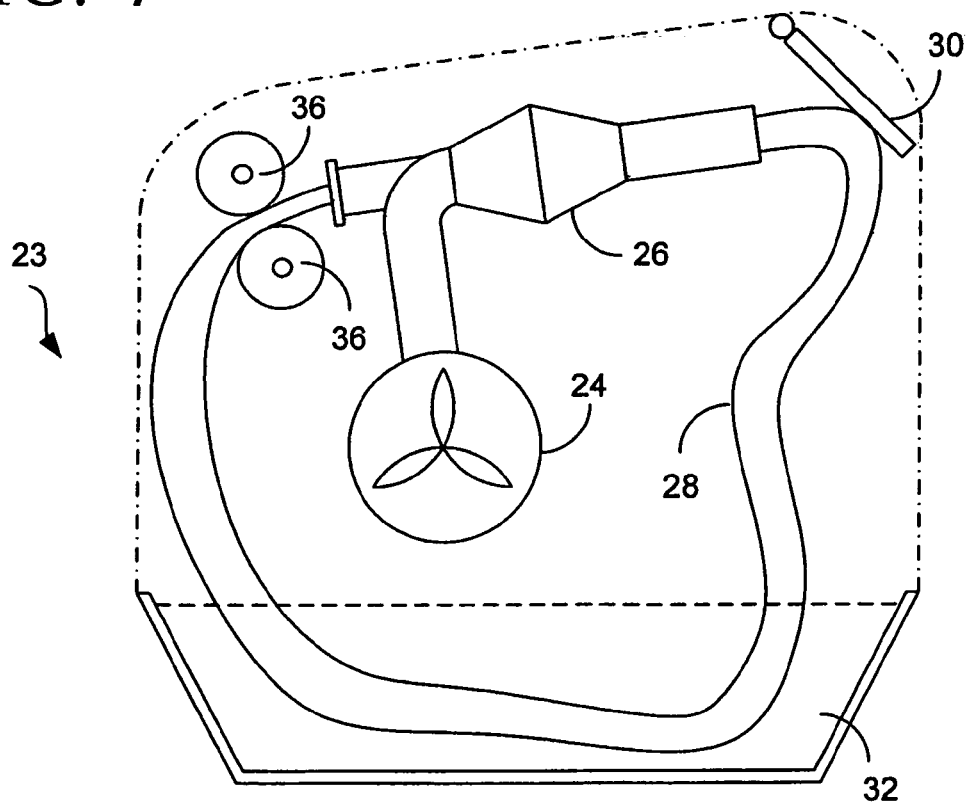
FIG. 4 illustrates a pneumatic-propulsion machine, which is an example machine for mechanically working fabric.

One type of mechanical working process that may be used to open the fabric structure is a pneumatic-propulsion machine 23, as shown in FIG. 4. In such a machine 23, a circulation mechanism 24, such as a fan, drives a stream of compressed air through a pneumatic-propulsion chamber 26. A continuous rope of fabric 28 provided within the chamber 26 is pneumatically conveyed by the stream of compressed air. As the fabric leaves the chamber 26, the stream of compressed air propels the fabric against an impact surface 30 that is positioned at the top of the machine 23. The fabric 28 impacts the impact surface 30 and drops down from the impact surface into a chamber 32 at the bottom of the machine. The fabric 28 is pulled from the chamber 32 by tumblers 36 that draw the fabric 28 up to the pneumatic-propulsion chamber 26. In this manner, the pneumatic-propulsion machine 23 circulates the fabric 28 such that the fabric is repetitively propelled against the impact surface 30. Working the fabric 28 in this manner modifies the structure of the fabric such that resulting fabric has increased thickness or "fluffiness."

One example of a suitable pneumatic-propulsion machine is the Airo® machine by Biancalani. An embodiment of the Airo® machine is described in U.S. Pat. No. 4,766,743, which is hereby incorporated by reference into the present disclosure. The Airo® machine is typically used for mechanically softening fabric to improve elasticity and drape. In the textile industry, characteristics such as those are commonly referred to as "hand" because the fabric feels softer to the touch when the characteristics are improved.

The pneumatic-propulsion process described in relation to FIG. 4 is but an example mechanical working process and other mechanical working processes may be utilized to produce an open structure. For example, a process may be selected that combines mechanical manipulation with chemical processing, such as a chemical treatment bath, or thermal-mechanical processing, for instance using heat and pressure. Additionally, a tumble-wash-dry machine may be used to process the fabric, or a machine may be selected that processes the fabric using a water jet or that uses air or water in combination with a tumble action.

In addition to the pneumatic-propulsion machine and the tumble-wash dry machine discussed above, other machines may be used to mechanical work the fabric. For example, batch-processing machines that may be used include the Flainox Multifinish, the Mat Combisoft, the Mat Rotormat, and the Zonco Eolo. Continuous machines that may be used include the Mat Tecnoplus, the Mat Vibrocompact, and the Biancalani Spyra. These machines are listed by way of example, and other machines may be used to perform the mechanical working.

The machine settings required to mechanically work the fabric vary depending on the process selected and/or the fabric to be worked. The settings may be selected so that the fabric structure may open up to the desired degree without the fabric becoming so abraded that the fabric loses wash durability. By way of example, the fabric may be mechanically worked using the pneumatic propulsion machine for times ranging from about 5 minutes to about 120 minutes, at temperatures ranging from about 20° C. to about 170° C., and at speeds ranging from about 10 yd/min to about 1000 yd/min. In some embodiments, the fabric may be mechanically worked for times ranging from about 30 to 60 minutes, at temperatures ranging from about 70° C. to about 100° C., and at speeds ranging from about 500 yd/min to about 800 yd/min.

Like the Biancalani Airo® machine, the machines disclosed above may improve the feel or the "hand" of the fabric in addition to improving the thermal protection provided by the fabric. Mechanical working may reduce the stiffness or rigidity of the fabric, and may increase the softness of the fabric. Therefore, the protective garment having the mechanically worked fabric may be more comfortable to the person wearing the garment.

Additionally, the machines disclosed above may produce a fabric that both has improved hand and is less likely to exhibit pilling. For example, in one embodiment, the fabric may have Murata Spun yarns that are less likely to exhibit pilling, and mechanically working the fabric may produce a fabric that has improved hand and is less likely to exhibit pilling.

After the fabric is mechanically worked, it may be finished using any desired fabric finishing processes. For example, the fabric may be dyed and/or a wicking finish may be applied. The fabric may then be cut into the appropriate shape for incorporation into the protective garment.

The protective garment may be constructed with at least one layer having fabric that has been subjected to the mechanical working process before the garment is formed. In embodiments in which the protective garment is a single layer, such as in FIG. 3, the fabric used to form the single layer may be mechanically worked before the protective garment is constructed. As a result of the mechanical working, the protective garment may exhibit improved thermal protection without being heavier, and may be less rigid and more comfortable to the wearer. By way of example, the protective garment may be a single layer of fabric having a weight per area in the range of approximately 3.0 oz/yd$^2$ to approximately 15.0 oz/yd$^2$. In some embodiments, the protective garment may be a single layer of fabric having a weight per area in the range of approximately 4.0 oz/yd$^2$ to approximately 10.0 oz/yd$^2$.

In embodiments in which the protective garment has multiple layers, at least one layer may be mechanically worked before the garment is constructed. For example, in embodiments in which the protective garment is turnout gear, such as in FIG. 1, one or both of the outer shell 14 and the thermal liner 16 may be mechanically worked. In embodiments in which the outer shell 14 is mechanically worked, the turnout gear 10 exhibits improved thermal protection per composite weight, and improved exterior softness. By way of example, the outer shell may have a weight in the range of about 4.0 oz/yd$^2$ to about 15 oz/yd$^2$. In embodiments in which the thermal liner 16 is mechanically worked, the turnout gear 10 exhibits improved thermal protection per composite weight, and improved interior softness. By way of example, the thermal liner may have a thickness in the range of about 0.010 inches to about 1.00 inch, and may have a weight per area in the range of about 1.0 oz/yd$^2$ to about 20 oz/yd$^2$. In some cases, the thermal liner may have a thickness in the range of about 0.050 inches to about 0.50 inch, and may have a weight in the range of about 4.0 oz/yd$^2$ to about 10 oz/yd$^2$.

In some embodiments, a layer of the turnout gear 10 may have constituent fabric layers that have been independently mechanically worked before being incorporated into the layer. For example, as is described above, the thermal liner 16 may have an insulation layer 18 and a facecloth layer 20. The insulation layer 18 and/or the facecloth layer 20 may be individually mechanically worked before the thermal liner 16 is constructed. Alternatively, the layers 18 and 20 may be assembled together, for example by quilting, and then the assembled thermal liner 16 may be mechanically worked.

Once the protective garment is constructed, the garment exhibits improved thermal protection relative to its weight. To measure thermal protection, manufacturers may perform heat transfer tests in a lab setting. For guidance regarding how to perform such tests and what type of performance is acceptable, manufacturers may look to test methods published by the National Fire Protection Association (NFPA) so that their protective garments may be labeled NFPA compliant.

For turnout gear 10, one such test method is the Thermal Protective Performance (TPP) test method published in NFPA 1971*: Standard on Protective Ensemble for Structural Fire Fighting,* 2000 edition. The NFPA 1971 TPP test method outlines a lab bench top test that can be used to measure heat transfer through turnout gear when exposed to flash fire conditions. The minimum TPP rating for a turnout gear to be NFPA 1971 compliant is 35 cal/cm$^2$, which is believed to allow the firefighter wearing the gear to be exposed to a 2 cal/cm$^2$s flash fire for 17.5 seconds before developing a second-degree burn.

TPP testing in accordance with NFPA 1971 was performed on various turnout gear samples (composites) to evaluate the effect of mechanically working at least one layer of the turnout gear in accordance with the above. Such composites are described in the following. A Control composite was constructed that included a thermal liner, a moisture barrier, and an outer shell. Test composites were also formed from the same materials and in the same manner as the Control composite except that one layer of the composite was mechanically worked before the test composite was constructed. A first composite, Composite A, was formed of the same materials and in the same manner as the Control composite except that the assembled thermal liner layer was mechanically worked using a pneumatic-propulsion machine before the composite was constructed. A second composite, Composite B was formed from the same materials and in the same manner as the Control composite except that the outer shell layer was mechanically worked using a pneumatic-propulsion machine before the composite was constructed. A third composite, Composite C, was also formed from the same materials and in the same manner as the Control composite except that the assembled thermal liner layer and the outer shell layer were independently mechanically worked using a pneumatic-propulsion machine before the composite was constructed.

Each sample (i.e., Control Composite, Composite A, Composite B, and Composite C) was tested in accordance with NFPA 1971, 2000 Edition, Section 6-10 Thermal Protective Performance (TPP) Test. As is apparent from Table 1 below, the test composites comprising at least one mechanically worked layer exhibited improved TPP ratings over the Control composite. Specifically, when the Control composite was altered such that a mechanically worked thermal liner was included (Composite A), the TPP rating of the composite increased by 7.2%. When the Control composite was altered such that a mechanically worked outer shell was included (Composite B), the TPP rating of the composite increased by 9.0%. When the Control composite was altered such that both the thermal liner and the outer shell were independently mechanically worked (Composite C), the TPP rating of the composite increased by 10.8%. Therefore, the results in Table 1 confirm that the TPP rating, and therefore the thermal protection of a protective garment, may be increased by including at least one mechanically worked layer in the composite.

Improving the NFPA 1971 TPP rating does not require an appreciable increase in the weight per square yard of the composite garment. Although, a slight increase in weight per square yard is indicated in Table 1, this increase is attributable to a moderate reduction in the length and width of the mechanically worked layer. Thus, NFPA 1971 TPP rating improvement can be achieved without a corresponding increase in weight, allowing the composite garment to provide improved thermal protection at substantially the same weight, or the same thermal protection at a lighter weight.

TABLE 1

| | Control Composite | Composite A | Composite B | Composite C |
|---|---|---|---|---|
| TPP Rating (cal/cm$^2$) | 33.4 | 35.8 | 36.4 | 37.0 |
| % Increase over Control | | 7.2% | 9.0% | 10.8% |
| Composite Weight per Area (oz/yd$^2$) | 20.2 | 20.3 | 20.4 | 20.5 |
| TPP per Weight [(cal/cm$^2$)/(oz/yd$^2$)] | 1.65 | 1.76 | 1.78 | 1.80 |
| | | 6.7% | 7.9% | 9.1% |

Mechanically working a layer increases thermal protection by increasing the thickness of the layer. Table 2 shows that such a mechanically worked thermal liner is 20.3% thicker than an identical thermal liner that is not mechanically worked. Table 2 further indicates that once a composite comprising the mechanically worked thermal liner is NFPA 1971 TPP tested, the TPP rating will exhibit a 7.2% increase. Therefore, mechanically working a layer increases the insulation provided by the layer, as evidenced by the increase in thickness without a corresponding increase in weight. This allows a garment to be made more thermally protective without being more restrictive or likely to cause heat stroke, as the increase in thickness is attributable to the increase in insulating air space and not to an increase in material.

TABLE 2

| | Control Composite | Composite A |
|---|---|---|
| Thermal Liner Thickness (in) | 0.064 | 0.077 |
| % Increase over Control Composite | | 20.3% |
| Composite Weight per Area (oz/yd$^2$) | 20.2 | 20.3 |
| TPP Rating (cal/cm$^2$s) | 334 | 35.8 |
| % Increase over Control Composite | | 7.2% |
| TPP per Weight [(cal/cm$^2$)/(oz/yd$^2$)] | 1.65 | 1.76 |
| % Increase over Control Composite | | 6.7% |

For single-layer protective garments, the NFPA standard is published in NFPA 2112: *Standard on Flame-Resistant Garments for Protection of Industrial Personnel Against Flash Fire,* 2001 edition. Like NFPA 1971, the NFPA 2112 TPP test method outlines a lab bench top test that can be used to measure heat transfer through the fabric of a single-layer garment when exposed to flash fire conditions. Because the NFPA 2112 test method is applied to the fabric of a single-layer garment, the test method calls for the TPP test to be performed with and without a spacer.

NFPA 2112 TPP testing was performed on sample single-layer protective fabrics to evaluate the effect of mechanically working the protective fabric in accordance with the above. A Control fabric was constructed that was a single layer of NOMEX IIIA fabric, the fibers having a blend of 93% meta-aramid, 5% para-aramid, and 2% anti-static fibers. The Control fabric was not mechanically worked. A Test fabric was also constructed having the same composition and formed in the same manner as the Control fabric, except that the Test fabric was mechanically worked.

Each fabric was tested in accordance with the NFPA 2112, 2001 Edition TPP Test. The results of these tests are provided in Table 3. The Test fabric that was mechanically worked exhibited improved NFPA 2112 TPP ratings over the Control fabric. Without the spacer, the Test fabric exhibited an 11.8% increase in TPP performance over the Control fabric. With the spacer, the Test fabric exhibited a 5.6% increase in TPP performance over the Control fabric. The results in Table 3 indicate that the TPP rating, and therefore the thermal protection provided by a single-layer protective garment, may be increased by mechanically working the fabric of the protective garment.

Table 3 also lists the weights per square yard of the Control and Test fabrics. As can be seen from Table 3, an appreciable increase in weight per square yard is not required to improve the NFPA 2112 TPP performance. Again, the weight per square yard of the fabric increases slightly because the mechanical working process due to slight shrinkage of the fabric. Thus, TPP rating improvement can be achieved without an appreciable increase in weight, allowing the a single-layer protective garment to provide improved thermal protection at the same weight, or the same thermal protection at a lighter weight.

TABLE 3

| | Control Fabric | Fabric A |
|---|---|---|
| Fabric Weight per Area (oz/yd$^2$) | 4.6 | 4.7 |
| % Increase over Control Fabric | | 2.2% |
| TPP Rating without Spacer (cal/cm$^2$s) | 6.8 | 7.6 |
| % Increase over Control Fabric | | 11.8% |
| TPP Rating with Spacer (cal/cm$^2$s) | 12.6 | 13.3 |
| % Increase over Control Fabric | | 5.6% |

As mentioned above, mechanical working also reduces the stiffness associated with a protective garment. Stiffness is typically measured in terms of flexural rigidity. One method for quantifying flexural rigidity is ASTM D 1388-96 (2002), "Standard Test Method for Stiffness of Fabrics," ASTM International, which is entirely incorporated herein by reference. The ASTM test method calls for a cantilever test to be performed on a cantilever-testing machine. The cantilever-testing machine has a horizontal plane, and a fabric specimen is slid along the horizontal plane until its leading edge hangs over the edge of the horizontal plane at a specified angle. The length of the overhang is then measured, and is used to calculate the bending length of the specimen using the following equation:

$$c=o/2 \quad \text{[Eq. 1]}$$

where c=bending length (cm) and o=length of overhang (cm). The bending length may then be used, along with the mass per unit area of the specimen, to calculate the flexural rigidity of the specimen using the following equation:

$$G=W\cdot c^3 \quad \text{[Eq. 2]}$$

where G=flexural rigidity (mg·cm), W=mass per unit area (mg/cm$^2$), and c=bending length (cm).

Testing was performed in accordance with ASTM D 1388-96 on sample layers of protective garments to evaluate the effect of mechanically working the layer in accordance with the above. Both a standard outer shell and a standard thermal barrier of a protective garment were tested. The outer shell specimens included a Control outer shell specimen that was not mechanically worked, and a Test outer shell specimen that was mechanically worked but was otherwise substantially identical to the Control outer shell specimen. The thermal barrier specimens included a Control thermal barrier specimen that was not mechanically worked, and a Test thermal barrier specimen that was mechanically worked but was otherwise substantially identical to the Control thermal barrier specimen. Each specimen was subjected to the Cantilever Test using a Shirley Stiffness Tester machine in accordance with ASTM D1388-96. For each specimen, the overhang length and the mass per unit area were measured, and the flexural rigidity was calculated.

The results of the tests are shown in Table 4. As indicated in Table 4, the outer shell specimens that were mechanically worked exhibited an average reduction in flexural rigidity of 80% in comparison to the Control outer shell specimens.

TABLE 4

| | Mass per Area | | Bending Length (cm) Specimen | | | | | Flexural Rigidity | | % |
|---|---|---|---|---|---|---|---|---|---|---|
| | mg/cm$^2$ | Direction | 1 | 2 | 3 | 4 | Ave. | mg · cm | Ave. | Reduced |
| Control Outer Shell | 26.1 | Warp | 6.50 | 5.45 | 5.35 | 6.40 | 5.93 | 5429 | 5007 | 80.3% |
| | | Fill | 5.50 | 5.95 | 5.25 | 5.70 | 5.60 | 4584 | | |
| Test Outer Shell | 26.1 | Warp | 3.80 | 3.35 | 3.65 | 3.70 | 3.63 | 1243 | 987 | |
| | | Fill | 2.75 | 2.80 | 3.60 | 3.00 | 3.04 | 732 | | |

The results of the thermal barrier tests and calculations are shown in Table 5. The thermal barrier specimens that were mechanically worked exhibited an average reduction in flexural rigidity of 57% in comparison to the Control thermal barrier specimens.

TABLE 5

| | Mass per Area | | Bending Length (cm) Specimen | | | | | Flexural Rigidity | | % |
|---|---|---|---|---|---|---|---|---|---|---|
| | mg/cm$^2$ | Direction | 1 | 2 | 3 | 4 | Ave. | mg · cm | Ave. | Reduced |
| Control Thermal Barrier | 26.1 | Warp | 6.10 | 5.95 | 5.75 | 5.60 | 5.85 | 5226 | 5226 | 57.3% |
| | | Fill | 5.45 | 6.10 | 5.70 | 6.15 | 5.85 | 5226 | | |
| Test Thermal Barrier | 27.1 | Warp | 4.90 | 4.45 | 5.05 | 4.75 | 4.79 | 2976 | 2232 | |
| | | Fill | 3.90 | 4.05 | 3.50 | 3.75 | 3.80 | 1488 | | |

Therefore, mechanical working at least one layer of a protective garment may increase the thermal protection provided by the garment, and may reduce the stiffness of the garment.

While particular embodiments of the protective garments have been disclosed in detail in the foregoing description and drawings for purposes of example, it will be understood by those skilled in the art that variations and modifications thereof can be made without departing from the scope of the disclosure.

The invention claimed is:

1. A method for forming a thermally protective fabric comprising:

pre-forming a fabric from inherently flame resistant fibers;

positioning the pre-formed fabric a distance from an impact surface; and mechanically working the pre-formed fabric by propelling the pre-formed fabric across the distance and against the impact surface to increase the thermal protection of the pre-formed fabric without a corresponding increase in the weight per square yard of the pre-formed fabric.

2. The method of claim 1, wherein the pre-formed fabric is propelled against the impact surface by a pneumatic propulsion machine.

3. The method of claim 2, wherein the pneumatic propulsion machine processes the pre-formed fabric for a time in the range of about 5 minutes to about 120 minutes, at a temperature in the range from about 20° C. to about 170° C., and at a speed in the range from about 10 yd/min to about 1000 yd/min.

4. The method of claim 3, wherein the pneumatic propulsion machine processes the pre-formed fabric for a time in the range of about 30 minutes to about 60 minutes, at a temperature in the range from about 70° C. to about 100° C., and at a speed in the range from about 500 yd/min to about 800 yd/min.

5. The method of claim 1, wherein the thermally protective fabric is configured for use as a thermal liner in turnout gear and wherein the inherently flame resistant fibers comprise at least one of aramid, melamine, FR rayon, modacrylic, and carbon.

6. The method of claim 1, wherein the thermally protective fabric is configured for use as an outer shell in turnout gear and wherein the inherently flame resistant fibers comprise at least one of aramid, polybenzimidazole, polybenzoxazole, polypyridobisimidazole, and melamine.

7. The method of claim 1, wherein the thermally protective fabric is configured for use as a single-layer protective garment, and wherein the inherently flame resistant fibers comprise at least one of aramid, polybenzimidazole, polybenzoxazole, polypyridobisimidazole, FR rayon and melamine.

8. The method of claim 1, wherein the inherently flame resistant fibers are formed from spun yarn.

9. A garment comprising at least one layer of the thermally protective fabric produced according to the method of claim 1.

10. The garment of claim 9, wherein the garment comprises multiple layers and the multiple layers comprise:

a thermal liner configured to insulate a wearer of the garment from heat;

a moisture barrier configured to limit the ingress of water into an interior of the garment; and an outer shell configured to shield the wearer from flames, wherein the at least one layer of the thermally protective fabric is the thermal liner.

11. The garment of claim 9, wherein the garment is less stiff than a similar garment comprising a thermal liner that has not been mechanically worked.

12. The garment of claim 9, wherein the inherently flame resistant fibers comprise at least one of aramid, melamine, FR rayon, modacrylic, and carbon.

13. The garment of claim 10, wherein the thermal liner has a thickness from approximately 0.010 inch to approximately 1.00 inch.

14. The garment of claim 10, wherein the thermal liner has a thickness from approximately 0.050 inch to approximately 0.50 inch.

15. The garment of claim 10, wherein the thermal liner has a weight from approximately 1.0 oz/yd$^2$ to approximately 20 oz/yd$^2$.

16. The garment of claim 10, wherein the thermal liner has a weight from approximately 4.0 oz/yd$^2$ to approximately 10 oz/yd$^2$.

17. The garment of claim 9, wherein the garment comprises multiple layers and the multiple layers comprise:

a thermal liner configured to insulate a wearer of the garment from heat;

a moisture barrier configured to limit the ingress of water into an interior of the garment; and an outer shell configured to shield the wearer from flames, wherein the at least one layer of the thermally protective fabric is the outer shell.

18. The garment of claim 17, wherein the garment is less stiff than a similar garment comprising an outer shell that has not been mechanically worked.

19. The garment of claim 17, wherein the inherently flame resistant fibers comprise at least one of aramid, polybenzimidazole, polybenzoxazole, polypyridobisimidazole, and melamine.

20. The garment of claim 17, wherein the outer shell has a weight from approximately 4.0 oz/yd$^2$ to approximately 15 oz/yd$^2$.

21. The garment of claim 9, comprising one layer.

22. The garment of claim 21, wherein the inherently flame resistant fibers comprise about 65% meta-aramid and about 35% FR rayon.

23. The garment of claim 21, wherein the inherently flame resistant fibers comprise about 60% para-aramid fiber and about 40% of one of meta-aramid, PBI, PBO, PIPD, or melamine.

24. The garment of claim 21, wherein the inherently flame resistant fibers comprise about 100% meta-aramid fibers.

25. The garment of claim 21, wherein the inherently flame resistant fibers comprise about 50% meta-aramid fibers and about 50% FR modacrylic fibers.

26. The garment of claim 21, wherein the inherently flame resistant fibers comprise about 60% FR Rayon and about 40% para-aramid.

27. The garment of claim 21, wherein the layer has a weight from approximately 3.0 oz/yd$^2$ to approximately 15.0 oz/yd$^2$.

28. The garment of claim 21, wherein the layer has a weight from approximately 4.0 oz/yd$^2$ to approximately 10.0 oz/yd$^2$.

29. The garment of claim 21, wherein the garment is less stiff than a similar garment comprising a layer that has not been mechanically worked.

30. The method of claim 1, wherein the pre-formed fabric is propelled against the impact surface by a tumble-wash-dry machine or a water jet.

31. A method of reducing the flexural rigidity of a thermally protective garment, the method comprising:

pre-forming a fabric from inherently flame resistant fibers;

positioning the pre-formed fabric a distance from an impact surface;

mechanically working the pre-formed fabric by propelling the pre-formed fabric across the distance and against the impact surface to increase the thermal protection of the pre-formed fabric without a corresponding increase in the weight per square yard of the pre-formed fabric; and constructing a thermally protective garment comprising the pre-formed fabric, the thermally protective garment having reduced flexural rigidity.

32. The method of claim 31, wherein the pre-formed fabric is propelled against the impact surface by a pneumatic propulsion machine.

33. The method of claim 32, wherein the pneumatic propulsion machine processes the pre-formed fabric for a time in the range of about 5 minutes to about 120 minutes, at a temperature in the range from about 20° C. to about 170° C., and at a speed in the range from about 10 yd/min to about 1000 yd/min.

34. The method of claim 31, wherein the pre-formed fabric is propelled against the impact surface by a tumble-wash-dry machine or a water jet.

35. The method of claim 1, wherein the thermal protection of a composite fabric incorporating the mechanically worked pre-formed fabric is increased by at least about 7% when tested in accordance with NFPA 1971 and the weight per square yard of the composite fabric is increased by no more than about 1.5% as compared to a control composite fabric having a pre-formed fabric that has not been mechanically worked.

36. The method of claim 31, wherein the thermal protection of a composite fabric incorporating the mechanically worked pre-formed fabric is increased by at least about 7% when tested in accordance with NFPA 1971 and the weight per square yard of the composite fabric is increased by no more than about 1.5% as compared to a control composite fabric having a pre-formed fabric that has not been mechanically worked.

37. The method of claim 1, wherein the thermal protection of the mechanically worked pre-formed fabric is increased by at least about 5% when tested in accordance with NFPA 2112 and the weight per square yard of the pre-formed fabric is increased by no more than about 3% as compared to a pre-formed fabric that has not been mechanically worked.

38. The method of claim 31, wherein the thermal protection of the mechanically worked pre-formed fabric is increased by at least about 5% when tested in accordance with NFPA 2112 and the weight per square yard of the pre-formed fabric is increased by no more than about 3% as compared to a pre-formed fabric that has not been mechanically worked.

39. The method of claim 1, wherein the pre-formed fabric is propelled across the distance and against the impact surface in a dry condition.

* * * * *